United States Patent [19]

Ogita et al.

[11] 4,389,854

[45] Jun. 28, 1983

[54] HIGH SPEED FREEZING SYSTEM FOR A REFRIGERATOR

[75] Inventors: Yasuhiro Ogita, Kyoto; Kazuya Kawasaki, Ibaraki; Kouichi Nagao, Ibaraki; Naoki Mori, Ibaraki, all of Japan

[73] Assignee: Tokyo Shibaura Denki Kabushiki Kaisha, Kawasaki, Japan

[21] Appl. No.: 306,642

[22] Filed: Sep. 29, 1981

[30] Foreign Application Priority Data

Oct. 3, 1980 [JP] Japan ..... 55-139126

[51] Int. Cl.[3] ..... G05D 23/32; F25D 29/00

[52] U.S. Cl. ..... 62/157; 62/163; 62/198; 62/231

[58] Field of Search ..... 62/157, 158, 231, 197, 62/198, 161, 162, 163, 164

[56] References Cited

U.S. PATENT DOCUMENTS

| | | | |
|---|---|---|---|
| 3,001,378 | 9/1961 | Stutrud | 62/157 |
| 4,128,854 | 12/1978 | Ruminsky | 62/158 |
| 4,142,375 | 3/1979 | Abe et al. | 62/231 |

FOREIGN PATENT DOCUMENTS

| | | |
|---|---|---|
| 53-162961 | 12/1978 | Japan . |
| 55-38433 | 3/1980 | Japan . |
| 55-43303 | 3/1980 | Japan . |

OTHER PUBLICATIONS

Kawashima et al., "Microcomputer Controlled Freezer-Refrigerator," *Toshiba Review,* No. 129, Sep.-Oct. 1980, pp. 36-40.

*Primary Examiner*—Albert J. Makay
*Assistant Examiner*—Harry Tanner
*Attorney, Agent, or Firm*—Cushman, Darby & Cushman

[57] ABSTRACT

A high speed freezing apparatus in use for a refrigerator. In the freezing apparatus, evaporators for the cold and freezing chambers are coupled in a series relation with respect to a compressor. An electromagnetic valve is provided in parallel with the evaporator for the cold chamber. When a high speed freezing start signal is produced from an operating section mounted on a front panel of a door for the freezing chamber, a timer circuit provided in a control section is operated. An operating condition of the compressor is detected by a detecting transformer and a given signal is produced from a start-failure preventing circuit. The start signal is transferred through a gate circuit to a relay portion only during the time that the given signal is transmitted to a gate circuit. Through the relay portion, the compressor and the electromagnetic valve are driven, so that the refrigerant is supplied to only the evaporator for the freezing chamber to start the high speed freezing operation. The time period of the high speed freezing operation is controlled by a timer circuit.

13 Claims, 6 Drawing Figures

HIGH SPEED FREEZING SYSTEM FOR A REFRIGERATOR

BACKGROUND OF THE INVENTION

The present invention relates to a freezing refrigerator, and more particularly to a high speed freezing apparatus which is adaptated for a referigerator with an evaporator for a freezing chamber and an evaporator for a cold chamber and which rapidly provides low temperature in a freezing chamber as required.

In a recent refrigerator of this type, two evaporators for the freezing chamber and the cold chamber are connected in series to a compressor and a condenser through a coolant path. A bypass line is connected in parallel to the evaporator for the cooling chamber so as to permit a refrigerant to flow into only the evaporator for the freezing chamber through an electromagnetic valve and a capillary tube, when desired. That is, the electromagnetic valve is connected so as to close and open interlocking with a given switch. When the electromagnetic valve is closed, the refrigerant delivered from the compressor is supplied to both the evaporators for the freezing and cold chambers. In a situation that temperature in the freezing chamber is desired to be set lower than a normal freezing temperature, for example, for conserving foods for a long time, in a freezed state, that is, in a so-called home freezing, a switch is operated by a user to open the electromagnetic valve. At this time, the refrigerant does not flow into the evaporator for the cold chamber but flows into only the evaporator for the freezing chamber by way of the bypassing path. Therefore, the freezing ability of the evaporator for the freezing chamber is enhanced, so that the temperature in the freezing chamber falls fast.

However, in a prior art refrigerator, the starting time of the high speed freezing operation in the freezing chamber must be properly determined in accordance with an operating condition of the compressor. If immediately after the compressor is stopped, the switch is operated to start the high speed freezing operation in the freezing chamber, the compressor often fails to start. In this case, the coolant gas flows unevenly precluding rapid freezing. In the worst case, the compressor fails. Therefore, the reliability of the refrigerator is not adequate.

SUMMARY OF THE INVENTION

Accordingly, an object of the present invention is to provide a reliable high speed freezing apparatus for a refrigerator which can perform a high speed freezing operation in a freezing chamber effectively.

A freezing apparatus for a refrigerator according to the present invention comprises at least two cooling means for respectively cooling mutually separated spaces within the refrigerator. These cooling means are coupled in series with each other through a compressor which is intermittently operated for delivering a refrigerant. A flow bypass portion is coupled in parallel with at least one of the cooling means, that is the first cooling means. There is also provided a signal generating means for generating at least a first electrical signal for initiating a high speed freezing operation mode. Coupled with the signal generating means is a timer means which operates in response to the first electrical signal to produce a second electrical signal for stopping the high speed freezing operation mode after the lapse of a given period of time from receiving the first electrical signal.

A detecting means detects an operating condition of the comprssor. When the compressor is stopped, the detecting means produces a third electrical signal to operate the compressor only after the lapse of a given period of time from stopping the compressor. A gate means is connected to the signal generating means, the timer means and the detecting means. During the period that the third electrical signal is supplied ffrom the detecting means, the gate means allows the first electrical signal to pass therethrough. During the period that the second electrical signal is supplied from the timer means, this gate means allows the second electrical signal to pass therethrough. The gate means is connected to a flow path control means. The flow path control means, therefore, selectively receives the first and second electrical signals supplied through the gate means, and selectively supplies the refrigerant to the flow bypass portion and the first cooling means in response to the first and second electrical signals. Upon the outputting of the first electrical signal from the signal generating means, the timer means starts its timing operation. An operating condition of the compressor is detected by a detecting means and when the compressor means is in the stop mode, said third electrical signal is generated after a given period of time from the point that the compressor is stopped. A gate means transmits a first electrical signal produced from said signal generating means to said drive means, so that the compressor starts its operation to open the valve means. When the valve means is open, the refrigerant flows into the evaporator other than the evaporators coupled in parallel with the valve means of the plurality of the evaporators.

BRIEF DESCRIPTION OF THE DRAWINGS

Other objects and features of the present invention will be apparent from the following description taken in connection with the accompanying drawings, in which.

DETAILED DESCRIPTION OF THE PREFERRED EMBODIMENT

Figure 1:
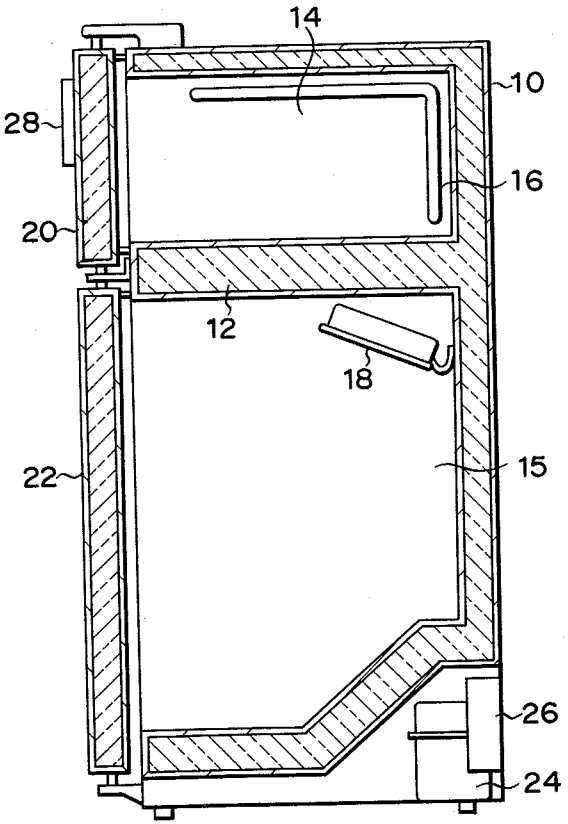
FIG. 1 shows a cross sectional view of a refrigerator with a high speed freezer according to the present invention.

Referring now to FIG. 1, there is shown an example of a cross section structure of a refrigerator incorporating a high speed freezing system, for example, a high speed freezer, which is an embodiment according to the present invention. A partition wall 12 is provided with an adiabatic box 10. The partition wall 12 partitions the adiabatic box 10 to form a freezing chamber 14 and a cold chamber 15. An evaporator 16 for intensively cooling only the freezing chamber is provided in the freezing chamber 14. Also within the cold chamber 15, another evaporator 18 for cooling only the cold chamber is provided. Known doors 20 and 22 are hinged at the front openings of the freezing and cold chambers 14 and 15, respectively. A known compressor 24 and a power source box 26 accommodating a voltage drop transformer, a relay, and the like (described later) are disposed at the rear end of the bottom of the refrigerator. An operating section 28 for the high speed freezing apparatus is mounted on the front panel of the door 20 for the freezing chamber 14.

Figure 2:
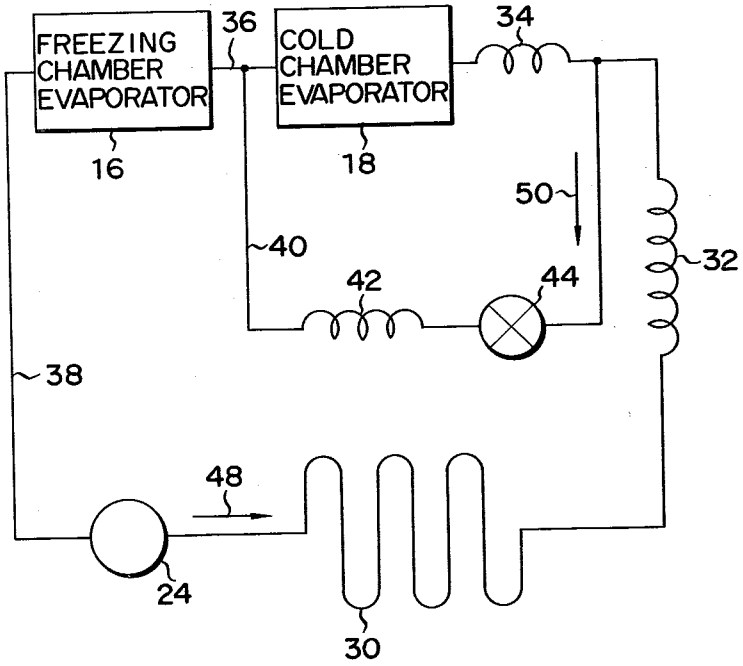
FIG. 2 shows a coolant circulating circuit of the refrigerator according to the present invention shown in FIG. 1.

A refrigerant circulating circuit of the freezing refrigerator is shown in FIG. 2.

One end of the compressor 24 is coupled with one end of the evaporator 18 for the cold chamber, through a condenser 30, a capillary tube 32 and an auxiliary capillary tube 34. The other end of the evaporator 18 for the cold chamber is coupled with one end of at least one evaporator 16 for the freezing chamber 14, through a pipe line 36. The other end of the evaporator 16 for the freezing chamber is coupled again with the compressor 24 through a pipe line 38. A bypass pipe line 40 is connected in parallel to the auxiliary capillary tube 34 and the evaporator 18 for the cold chamber. The bypass pipe line 40 includes an electromagnetic valve 44 and a bypass capillary tube 42, connected in series. A plurality of evaporators may of course be provided in the freezing chamber 14 and also in the cold chamber 16.

In such a refrigerant circulating circuit of FIG. 2, the electromagnetic valve 44 is normally closed and is opened by being supplied with the power. Accordingly, when the electromagnetic valve 44 is closed, the refrigerant transferred from the compressor 24 in the direction of an arrow 48 flows through both the evaporators 18 and 16 for the cold chamber and the freezing chamber. Because the closed electromagnetic valve 44 prevents the refrigerant from flowing into the bypass pipe line 40 with the bypass capillary tube 42. The coolant flowing through both evaporators 18 and 16 are returned to the compressor 24 through the pipe line 38. When the electromagnetic valve 44 is opened, the refrigerant delivered from the compressor 24 flows through the condenser 30 and the main capillary tube 32, and then flows in the direction of an arrow 50. Thus, the refrigerant flows through the opened electromagnetic valve 44 and the bypass capillary 42, and returns to the compressor 24 through the evaporator 16 for the freezing chamber. In other words, if the electromagnetic valve 44 is closed, the refrigerant flows through both the evaporators 18 and 16. When the electromagnetic valve 44 is opened, the refrigerant flows through only the evaporator 16 for the freezing chamber.

Figure 4:
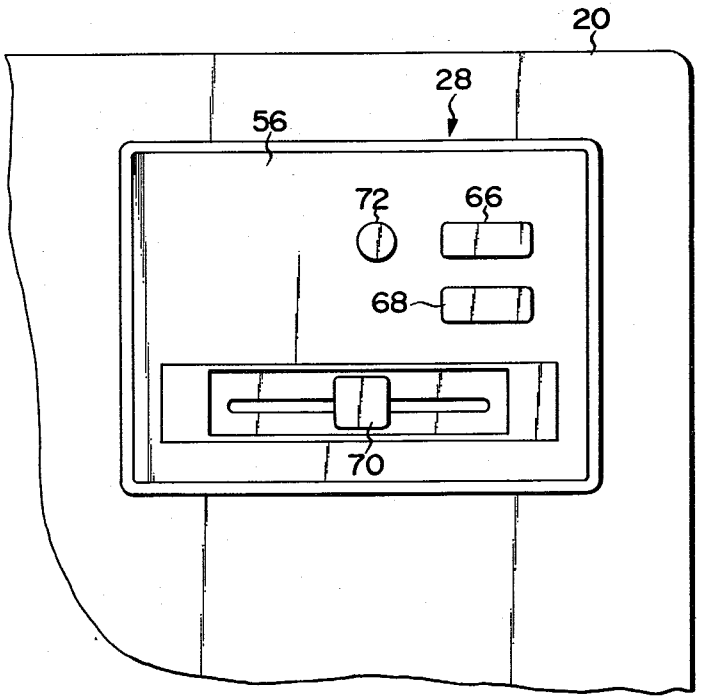
FIG. 4 is a front view of the operating section in FIG. 3.
Figure 3:
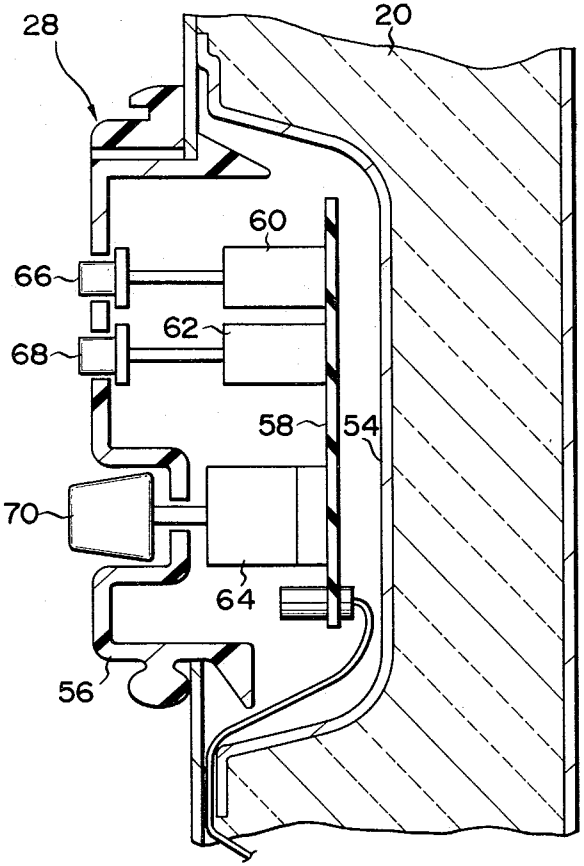
FIG. 3 is a partial cross sectional view of an operating section provided on a door for the freezing chamber of a refrigerator shown in FIG. 1.

The operating section 28 provided on the door 20 for the freezing chamber shown in FIG. 1 is illustrated in FIGS. 3 and 4. In FIG. 3, the door 20 and the operating section 28 are separated by the partitioning plate 54. On the front panel of the operating section, an outer member 56, for example, plastic molded, is mounted. A printed circuit board 58 is provided within the operating section 28. Push lock switches 60 and 62 mounted on the printed circuit board 58, and a variable resistor 64 of the linear sliding type is also mounted thereon. The push lock switch 60 has an operating knob 66 serving as a high speed freezing start switch, for example, for the high speed freezing apparatus according to the present invention. The push lock switch 62 has an operating knob 68 serving as a high speed freezing stop switch. The variable resistor 64 has an operating knob 70 and serves for setting a desired operation time period of the high speed freezing apparatus. FIG. 4 is a front view of the operating section 28. The knob 66 for the high speed freezing start switch and the knob 68 for the high speed freezing stop switch are arranged on the right upper part, for example, of an outer member 56 (a front cover of the operating section). The knob 70 for the high speed freezing time designator is provided on the lower part of the front cover 56 and is set slidable rectilinearly in the horizontal direction. A light emitting member 72 made of LED lamp, for example, is mounted to the front cover 56. The LED lamp 72 operates interlocking with the switches 66 and 68 to emit a given visible light during the high speed freezing time period. An operator or a user can check by the light emitting from the lamp 72 that the refrigerator is in the high speed freezing mode.

Figure 5:
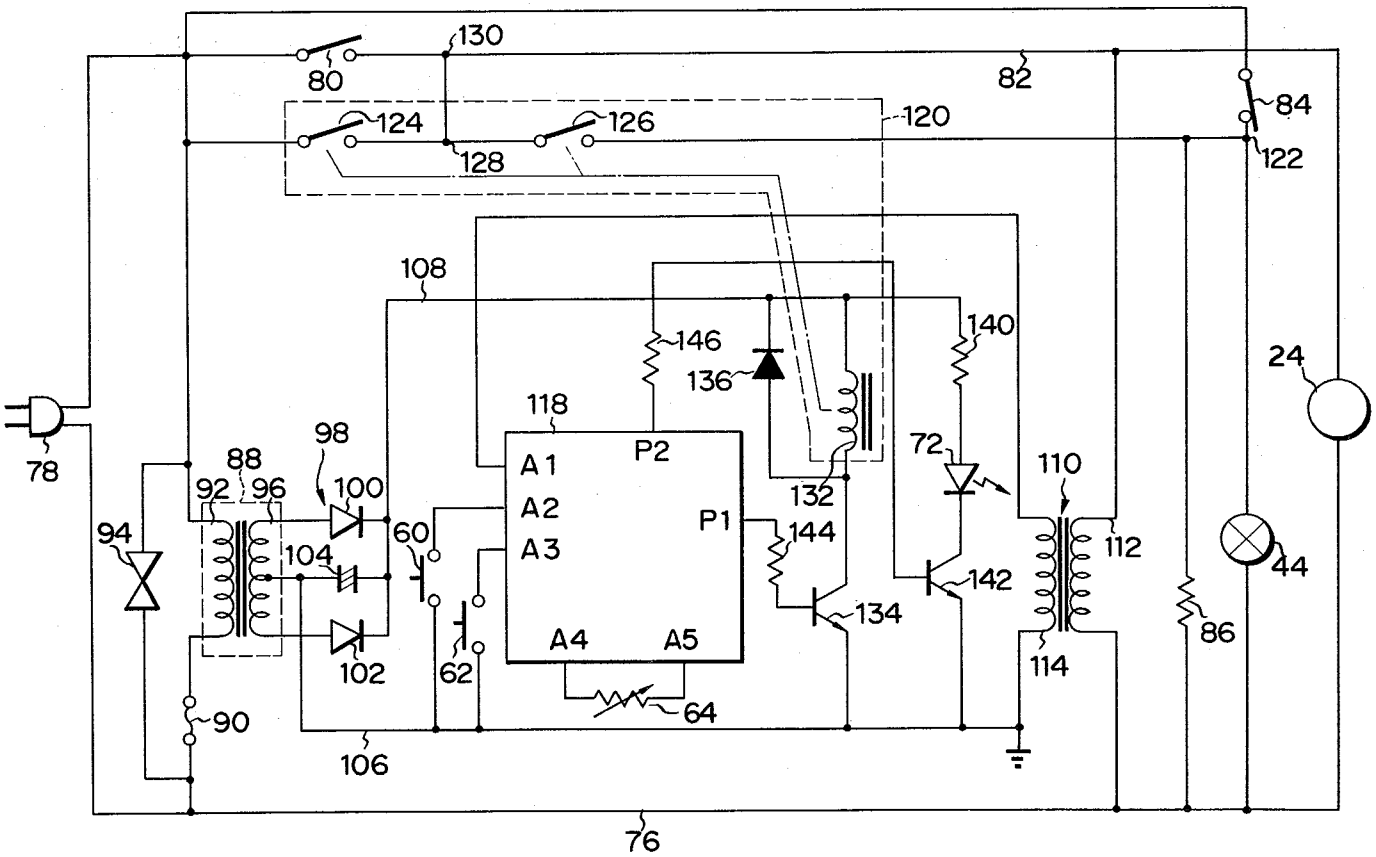
FIG. 5 illustrates an overall circuit arrangement of an embodiment of a high speed freezing apparatus according to the present invention.

FIG. 5 shows an overall electric circuit arrangement of a high speed freezing apparatus as an embodiment of the present invention. One terminal of the compressor 24 is directly connected with one terminal of a power source plug 78 to be connected to a commercial power source (not shown) by way of a line 76. The other terminal of the compressor 24 is connected with the other terminal of the power source plug 78 via a switch member 80 inserted in the path of a line 82. The switch member 80 is provided in the freezing chamber 14 of the refrigerator shown in FIG. 1, and the switch member 80 senses temperature in the freezing chamber 14. Then the member 80 works as a freezing chamber temperature sensing switch which closes when the freezing chamber temperature rises to exceed a predetermined first reference temperature. A series circuit including the electromagnetic valve 44 and another switch member 84 is connected between both the terminals of the power source plug 78. The switch member 84 provided in the cold chamber 15 senses temperature in the cold chamber and works as a cold chamber temperature sensing switch which closes when the cold chamber temperature rises high than a predetermined second reference temperature. A resistor 86 is connected in parallel with the electromagnetic valve 44. The resistor 86 is provided adjacent to a flow tube 36 coupled between the evaporator 16 for the freezing chamber and the evaporator 18 for the cold chamber in FIG. 2. The resistor 86 serves as a heating wire which heats the flow tube 36.

A series circuit of a transformer 88 for dropping the voltage and a temperature fuse 90 is provided between both the terminals of the power source plug 78. To be specific, one end of a primary winding 92 of the transformer 88 is directly connected to the line 82. The other end of the primary coil 92 is connected to the line 76 by way of the fuse 90. A varistor 94 which is publicly known is connected in parallel to the series circuit of the primary winding 92 of the transformer 88 and the fuse 90. A secondary winding 96 of the transformer 88 is coupled with a rectifying circuit 98 of the center tapping type. The rectifying circuit 98 is comprised of two diodes 100 and 102 and a smoothing capacitor 104. A center tap of the secondary winding 96 is connected with a ground line 106. Cathodes of the two diodes 100 and 102 in the rectifying circuit 98 and one end of the capacitor 104 are commonly connected one another and connected with a power source line 108. A DC low voltage obtained by dropping an input AC voltage by the transformer 88 and rectified by the rectifying circuit 98, appears between a ground line 106 and the power source line 108.

A primary winding 112 of another transformer 110 is connected between both the terminals of the compressor 24. The transformer 110 serves as a detecting transformer for detecting an operating condition of the compressor 24. A secondary winding 114 of the transformer 110 is connected between a first input terminal A1 of a control circuit 118 to be described later and the ground line 106. The detecting transformer 110 is so arranged as to generate a detecting voltage of about 7 V, for example, at its secondary winding 114 when the compressor 24 is driven. Reference numeral 120 designates a relay circuit. The relay circuit 120 includes a couple of normally open switch members 124 and 126, for example. The two normally open switch members 124 and 126 are connected between one end of the power source plug 78 and a common connection point 122 of a cold chamber temperature sensing switch 84 and the electromagnetic valve 44. In other words, the one end of the power source plug 78 is connected to the common connection point 122 by way of these switches 124 and 126. A common connection point 128 of these normally open switches 124 and 126 is directly connected with a common connection point 130 of the freezing chamber temperature sensing switch 80 and the compressor 24.

A series circuit of an exciting coil 132 included in the relay portion 120 and an NPN transistor 134 is connected between the ground line 106 and the power source line 108. In other words, one end of the exciting coil 132 is grounded via a collector and an emitter of the transistor 134. The relay portion 120 and the transistor 134 make up a high speed freezing operating circuit. A diode 136 is provided in parallel with the exciting coil 132. The diode 136 is for protecting the transistor 134. Further, a series circuit of a resistor 140, the LED 72 and an NPN transistor 142 is provided between these lines 106 and 108. A cathode of the LED 72 is connected to the ground conductor 106 through a collector and an emitter of the transistor 142. An anode of the LED is connected with the power source line 108 by way of the resistor 140. Bases of the two transistors 134 and 142 are connected to output terminals P1 and P2 of the control section 118 via resistors 144 and 146, respectively. The high speed freezing switch 60 and the high speed freezing stop switch 62 (FIG. 3) are connected to second and third input terminals A2 and A3 of the control circuit 118 respectively. The other ends of these switches 60 and 62 are grounded. The high speed freezing time designator 64 (FIG. 3) is also connected between fourth and fifth input terminals A4 and A5 of the control circuit 118. In addition, the transformer 88, the fuse 90, the varistor 94, the rectifying circuit 98, the detecting transformer 110 and the relay portion 120 are stored in the power source box 26 shown in FIG. 1.

Figure 6:
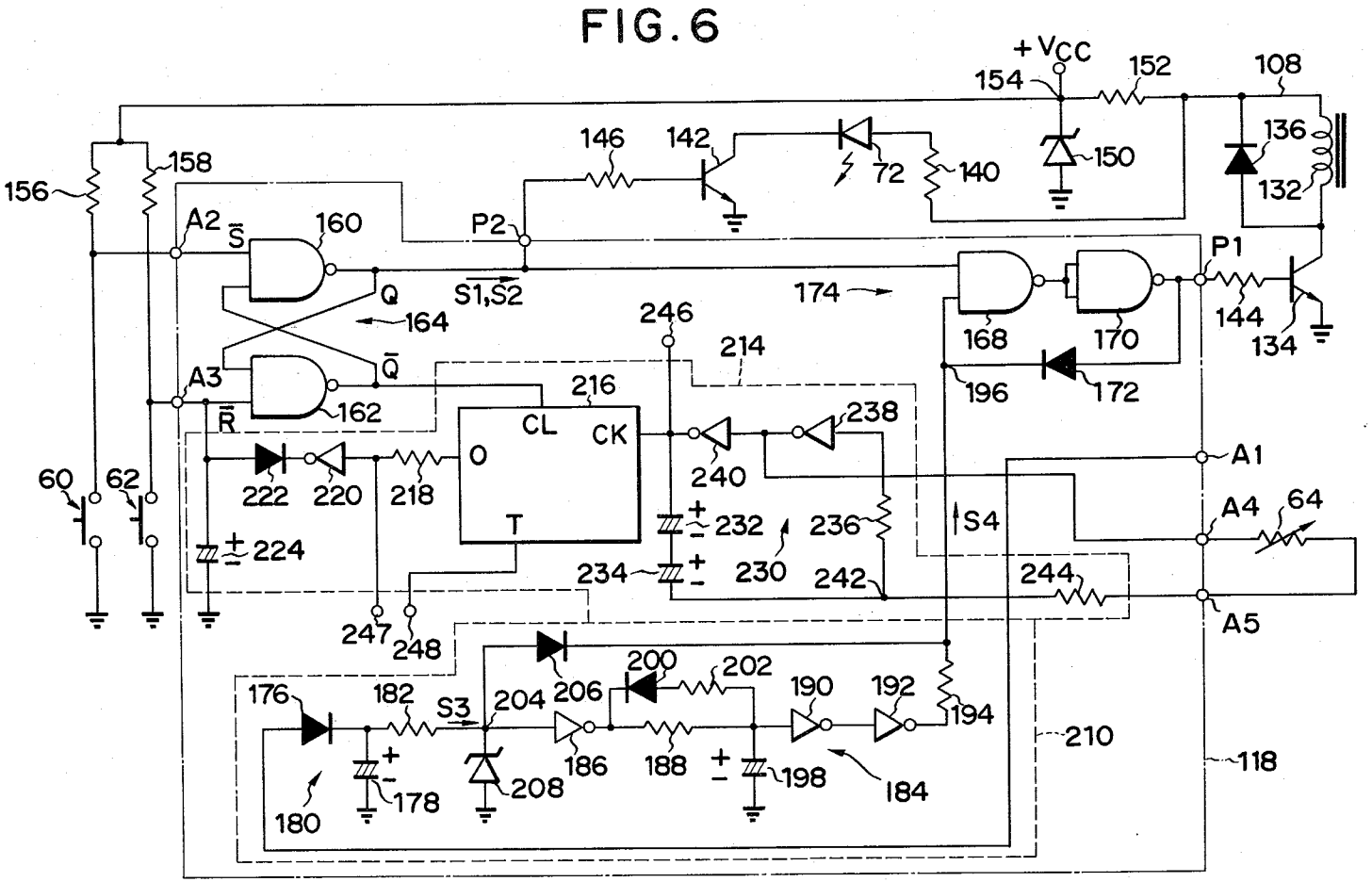
FIG. 6 shows a circuit arrangement of a control section used in an embodiment of a high speed freezing apparatus according to the present invention shown in FIG. 5.

The control circuit 118 is shown in more detail in FIG. 6 in which like reference symbols are used to designate like portions in FIG. 5. A cathode of a Zener diode 150 is connected with the power source line 108 via a resistor 152. An anode of the Zener diode 150 is grounded. A common connection point 154 of the Zener diode 150 and the resistor 152 has a DC constant voltage applied thereto, that is, a source voltage +Vcc. The common connection point 154 is connected to one terminal of each of resistors 156 and 158. The other terminal of each of resistors 156 and 158 is connected with each of input terminals A2 and A3 of the control section 118. Accordingly, the input terminals A2 and A3 of the control section 118 independently receive a low voltage signal of which voltage is substantially equal to a ground potential only when the high speed freezing start switch 60 and the high speed freezing stop switch 62 are closed. When the switches 60 and 62 open, a high voltage signal at which voltage substantially equal to the power source voltage +Vcc is applied to the input terminals A2 and A3.

In the control circuit 118, each of the input terminals A2 and A3 are connected to one input terminal of each of first and second NAND networks 160 and 162. The other input terminal of the first NAND network 160 is directly connected with an output terminal of the second NAND network 162. The other terminal of the second NAND network 162 is directly connected to an output terminal of the first NAND network 160. These NAND networks 160 and 162 form an R-S flip-flop 164. To be more specific, the input terminal of the first NAND network 160 connected with the input terminal A2 serves as a set input terminal $\overline{S}$ of the R-S flip-flop 164. The input terminal of the second NAND network 162 connected with the input terminal A3 serves as a reset input terminal R of the R-S flip-flop 164. When the high speed freezing start switch 60 is closed, the flip-flop 164 receives a low voltage signal at its set input terminal $\overline{S}$. Also it receives a high voltage signal at its reset input terminal $\overline{R}$. And the flip-flop 164 continuously outputs a high voltage signal from an output terminal (a set output terminal) Q of the first NAND network 160. This high voltage signal is a high speed freezing start signal S1. On the other hand, when the high speed freezing stop switch 62 is closed, the flip-flop 164 receives a high voltage signal at the set input terminal $\overline{S}$. Also, it receives a low voltage signal at the reset input terminal $\overline{R}$. A low voltage signal is continuously produced from the set output terminal Q. This low voltage signal is a high speed freezing stop signal S2.

The output terminal, that is, the set output terminal Q, of the R-S flip-flop 164 is connected to an input terminal of a third NAND network 168 and also the output terminal is connected with a second output terminal P2 of the control section 118. An output terminal of the third NAND network 168 is connected with a couple of input terminals of a fourth NAND network 170. An output terminal of the fourth NAND network 170 is connected to a first output terminal P1 of the control section 118, also it is connected to an anode of a diode 172. A cathode of the diode 172 is connected with the other input terminal of the third NAND network 168. These NAND networks 168 and 170 and the diode 172 cooperatively form a gate circuit 174.

A first input terminal A1 of the control section 118 is connected to an anode of a diode 176. A smoothing capacitor 178 is provided between a cathode of the diode 176 and ground. The diode 176 and the capacitor 178 make up a rectifying circuit 180. This rectifying circuit 180 rectifies a detecting voltage produced from the transformer 110 shown in FIG. 5, and it produces an output signal S3 by way of a resistor 182. The output signal S3 is a signal having a rectified voltage. The signal is further supplied to a delay timer circuit 184 which includes an inverter 186. An input terminal of the inverter 186 is connected to the resistor 182. An output terminal of the inverter 186 is connected to a common connection point 196 of the other input terminal of the third NAND network 168 and the input terminal of the diode 172 provided in the gate circuit 174, through a resistor 188, a couple of inverters 190 and 192 and a resistor 194. A charge/discharge capacitor 198 is provided between an input terminal of the inverter 190 and ground. A series circuit of a diode 200 and a resistor 202 is connected in parallel with the resistor 188. A common connection point 204 of the resistor 182 and the inverter 186 is connected to the common connection point 196 of the gate circuit 174 via a diode 206. Further, a Zener diode 208 is provided between the common connection point 204 and ground. A Zener voltage of the Zener diode 208 is lower than that of the Zener diode 150. When the compressor 24 (FIG. 5) stops its operation and the detecting voltage produced from the transformer 110 disappears, a potential of the common connection point 204 changes to zero potential. Therefore, the output of the inverter 186 is inverted to have a high potential. At this time, the capacitor 198 provided in the delay timer circuit 184 is charged since one end of the capacitor 198 is supplied with the high voltage through the resistor 188. On the other hand, when the compressor 24 (FIG. 5) is operated, a detecting voltage signal is produced from the detecting transformer 110 (FIG. 5) and the detecting voltage signal is fed to the rectifying circuit 180. The rectifying circuit 180 performs the above-mentioned operation, thereby outputting the output signal S3 to the common connection terminal 204. As a result, a potential of the output terminal of the inverter 186 is inverted to a zero potential and charges stored in the capacitor 198 is discharged through the resistor 202 and the diode 200. A start-failure preventing circuit 210 is comprised of the rectifying circuit 180 and the delay timer circuit 184, and the circuit 210 produces a constraint signal S4 at a low potential during a charge period of the capacitor 198. The charge period of the capacitor 198 corresponds to a time constant determined by the capacitor 198 and the resistor 188. The charge period is set at a predetermined one, for example, 5 minutes from the time when the compressor 24 (FIG. 5) stops. After the predetermined time is passed, the start-failure preventing circuit 210 outputs the signal S3 having a high potential.

A timer circuit 214 includes a counter 216. A clear terminal CL of the counter 216 is connected to the output terminal of the second NAND network 162 forming the R-S flip-flop 164. The counter 216 counts a number of pulses of a pulse signal supplied to a clock terminal CK, when a potential of the clear terminal CL is a low potential. This counter 216 is so arranged that it produces a high potential signal from its output terminal O when a counted data value reaches a predetermined value. Conversely, a potential at the clear terminal CL becomes high, the contents of the counter 216 returns to the initial condition, and a low potential appears at the output terminal O. The output terminal O of the counter 216 is connected to a cathode of a diode 222 by way of a resistor 218 and an inverter 220. An anode of the diode 222 is connected to the reset terminal R of the R-S flip-flop 164, and it is grounded through a capacitor 224. The clock terminal CK of the counter 216 is connected with an oscillator 230. The oscillator 230 generates a clock pulse signal which in turn is supplied to the counter 216. An end of a series circuit including couple of capacitors 232 and 234 provided in the oscillator 230 is connected with the clock terminal CK of the counter 216. The other end of the series circuit is again connected to the clock terminal CK via a resistor 236 for feed back and two inverters 238 and 240. A common connection point 242 of the capacitor 234 and the feed back resistor 236 is connected with a fifth input terminal A5 of the control section 118 through a resistor 244. A common connection of an output terminal of the inverter 238 and an input terminal of the inverter 240 is connected to a fourth input terminal A4 of the control section 118. The oscillator 230 thus arranged performs an astable oscillation at the oscillating period adjustable by the high speed freezing time designator 64 comprised of a variable resistor. In the timer circuit 214, a counting speed of the counter 216 may be changed by the high speed freezing time designator 64. Therefore, a time period (timer operation period) until a high potential signal is produced from the output terminal O of the counter 216 may freely be set within the time range from thirty minutes to ninety minutes, for example.

The first to fourth NAND networks 160, 162, 168 and 170, inverters 186, 190, 220, 238 and 240 and the counter 216 provided in the control section 118 are formed on one chip in an integrated manner. A driving power source for these parts is fed from the DC constant voltage +Vcc. In addition, terminals 246, 247 and 248 are test terminals, and used when the timer terminal is inspected in the manufacturing process in a factory, for example.

The operation of a refrigerator having a high speed freezing apparatus thus constructed which is an embodiment of the present invention will now be described. In a usual refrigerating mode in which no high speed freezing operation is performed, when the temperatures in the freezing chamber 14 and the cold chamber 16 are higher than a predetermined temperature, the freezing chamber temperature sensing switch 80 is closed. At this time, the compressor 24 is driven. The cold chamber temperature sensing switch 84 is opened, and then the valve 44 is closed. Accordingly, the refrigerant provided from the compressor 24 flows through both the evaporator 18 for the cold chamber and the evaporator 16 for the freezing chamber (the first condition), so that the freezing chamber 14 and the cold chamber 15 are cooled.

After this, the temperature of the cold chamber 16 becomes low, and when it is lower than the predetermined temperature, the cold chamber temperature sensing switch 84 is closed. As a result, power is applied to the electromagnetic valve 44 and the valve 44 is opened. Then, the coolant from the compressor 24 flows only through the first evaporator 16 provided in the freezing chamber (the second condition). In such an operation mode in which only the freezing chamber is cooled, the temperature in the freezing chamber 14 becomes lower. When the temperature in the freezing chamber 14 is lower than the predetermined optimum temperature, the freezing chamber temperature sensing switch 80 is opened. At this time, the power for the compressor 24 is stopped, and the circulation of the refrigerant is stopped. In this non-operating condition (rest condition), the operations of both the evaporators 16 and 18 are stopped. Therefore, the temperatures in the freezing chamber 14 and the cold chamber 15 do not fall but rather gradually rise. The temperature of the freezing chamber 14 progressively rises and exceeds the predetermined temperature. Then, the freezing chamber temperature sensing switch 80 is closed again to supply the power to the compressor 24. Then, the compressor starts its operation. Subsequently, the same operation as the above one is repeated and therefore no further description of it will be given.

Let us next consider a case where some food such as fish must be freezed quickly. In this case, a user operates the high speed freezing time designator 64, and a high speed freezing operation mode time is set at 30 minutes, for example. The knob 66 of the high speed freezing start switch 60 is then pushed. At this time, the set output signal S1, or the start signal, at a high potential is produced from the set output terminal $\overline{Q}$ of the R-S flip-flop 164 provided in the control section 118 shown in FIG. 6. Simultaneously, a low potential signal is outputted from the reset output terminal $\overline{Q}$ of the flip-flop 164 and is supplied to the clear terminal CL of the counter 216. Accordingly, the counter 216 starts its operation, and the pulse components of the pulse signal produced from the oscillator 230 are counted by the counter 216. Also, the timer circuit 214 starts its operation. At the time when this timer circuit 214 starts its operation, the contents of the counter 216 are forced to return to the initial condition as will be described later. The start signal S1 is applied to the base of the transistor 142 via the second output terminal P2 of the control section 118 and the resistor 146. As a result, the transistor 142 is conductive and the LED 72 is lit. Therefore, the user can recognize that the high speed freezing operation is started, by seeing the light from the LED 72.

At the time when the start signal S1 is produced, two cases must be considered. In one case, the compressor 24 has already started its operation. In the other case, the compressor 24 stops.

Firstly, the latter case where the start signal S1 is produced and the compressor 24 stops will be described. During the period of the predetermined time, for example, 5 minutes after the compressor 24 stops, the constraint signal S4 having a low potential is produced from the start-failure preventing circuit 210, and the signal S4 is transmitted to the third NAND network 168 of the gate circuit 174. After that period, the output signal S3 having a high potential is produced from the start-failure preventing circuit 210. To be more specific, during the period of the predetermined time, 5 minutes, for example, after the compressor 24 stops, the gate circuit 174 provided in the control section 118 prohibits the start signal S1 from passing therethrough. After that time period, the start signal S1 is allowed to pass through the gate circuit 174. The start signal S1, after passing through the gate circuit 174, is supplied to the base of the transistor 134 by way of the first output terminal P1 of the control section 118 and the resistor 114. At this time, the transistor 134 is conductive, power is supplied to the exciting coil 132, and the normally open contacts 124 and 126 (FIG. 5) are closed. When one normally open contact 124 is closed, power is supplied to the compressor 24. When the normally open contacts 124 and 126 are closed, power is supplied to the electromagnetic valve 44 to close the valve 44. This condition corresponds to the second condition as mentioned above. Accordingly, the coolant gas transmitted from the compressor 24 is supplied only to the evaporator 16 for the freezing chamber to make the temperature in the freezing chamber 14 fall. As a result, the food is cooled to −30° C., for example.

After the high speed freezing time of 30 minutes since the start of the high speed freezing operation, the timer operation of the timer circuit 214 terminates. At this time, a high potential signal is produced from the output terminal O of the counter 216 and is inverted to a low potential signal by the inverter 220. The inverted low potential signal is transmitted to the reset input terminal $\overline{R}$ of the flip-flop 164 via the diode 222. The set input terminal $\overline{S}$ of the flip-flop 164 is supplied with a high potential signal. Therefore, the high speed freezing stop signal S2 at a low potential is produced from the output terminal Q of the flip-flop 164. This high speed freezing stop signal S2 is transmitted to the base of the transistor 134 through the gate circuit 174, the first output terminal P1 of the control section 118 and the resistor 144. The transistor 134 is cut off and the two normally open contacts 124 and 126 of the relay portion 120 are opened. Accordingly, the current flowing through the compressor 24 via the normally open contact 124 and the current flowing through the electromagnetic valve 44 via the normally open contacts 124 and 126 are both shut off. At this time the compressor 24 and the electromagnetic valve 44 stop their operations, and the high speed freezing operation terminates. On the other hand, the stop signal S2 having a low potential is supplied to the base of the transistor 142 by way of the second output terminal P2 of the control section 118 and the resistor 146. At this time, the transistor 142 is cut off and the LED 72 is turned off. Simultaneously, a high potential signal produced from the reset output terminal $\overline{Q}$ of the flip-flop 164 is supplied to the clear terminal CL of the counter 216. Receiving this high potential signal, the contents of the counter 216 are cleared and returned to the initial state. As a result, the timer circuit 214 is returned to the initial state. Additionally, in case where the user closes the high speed freezing stop switch 62, the stop signal S2 is also produced from the R-S flip-flop 164 in the same manner. Therefore, the same operation as mentioned above is performed, so that the high speed freezing operation is forced to stop.

Description will be given about another case where the compressor 24 has already operated at the time when the high speed freezing start signal S1 is produced from the flip-flop 164. The detected voltage signal produced from the detecting transformer 110, during the course of the operation of the compressor 24, is supplied to the first input terminal A1 of the control section 118 as shown in FIG. 5. In FIG. 6, the detected voltage signal is converted into the output signal S3 by the rectifying circuit 180 provided in the control section 118. The signal S3 is transmitted to the third NAND network 168 provided in the gate circuit 174 via the diode 206. If the user operates the high speed freezing stop switch 62 and closes it under this condition, the high speed freezing start signal S1 is outputted from the flip-flop 164 in a similar manner to the above-mentioned one. This signal S1 is transmitted to the base of the transistor 134 by way of the gate circuit 174, the first output terminal P1 of the control section 118 and the resistor 144. When the transistor 134 is conductive, the two normally open contacts 124 and 126 (FIG. 5) of the relay portion 120 are closed. As a result, current flows through the compressor 24 via the normally open contact 124. Therefore, the compressor 24 is driven through the closed normally open contact 124, irrespective of the close or open of the freezing chamber temperature sensing switch 80. Further, current flows through the electromagnetic valve 44 via the two normally open contacts 124 and 126. Accordingly, the electromagnetic valve 44 is supplied with power through the closed normally open contacts 124 and 126, irrespective of the open or close of the cold chamber temperature sensing switch 84, whereby the valve 44 is opened. As a result, the coolant discharged from the compressor 24 flows through only the evaporator 16 for the freezing chamber 14. Then, the condition of the refrigerator is switched to the second condition in which only the freezing chamber 14 (FIG. 1) is extremely cooled.

The operation of the high speed freezing apparatus which is an embodiment of the present invention is as mentioned above.

According to the high speed freezing apparatus thus arranged which is an embodiment of the present invention, the control section 118 including the gate circuit 174, the start-failure preventing circuit 210 and the timer circuit 214, and the detecting transformer 120 are provided together with the compressor 24 and the electromagnetic valve 44. Accordingly, the operating condition of the compressor 24 (either driven or not) is always detected by the detecting transformer 120. Therefore, the high speed freezing operation is properly controlled by the control section 118 in accordance with the operating condition of the compressor 24 at the time of detecting. Therefore, the user can start the high speed freezing operation at any time he wants to operate irrespective of the operating condition of the compressor 24. Also, the compressor 24 is free from start failure. Accordingly, the high speed freezing operation is performed efficiently and safely.

Further, the electronic circuit concerning with the high speed freezing apparatus can be integrated on one chip substrate. Therefore, contacts of mechanic switches are not necessarily used and a problem such as poor contact are prevented. Consequently, the reliability of the apparatus is improved and the apparatus can be made small in size.

Although the present invention has been shown and described with respect to a particular embodiment, nevertheless, various changes and modifications which are obvious to a person skilled in the art to which the invention pertains are deemed to lie within the spirit, scope, and contemplation of the invention.

What we claim is:

1. A freezing apparatus for a refrigerator having a cold chamber and a freezing chamber, comprising:

(a) first and second cooling means respectively disposed in said cold and freezing chambers for cooling the inner spaces of said cold and freezing chambers, respectively, said first and second cooling means being coupled in series between both ends of a series arrangement of a compressor and a condenser, said compressor being intermittently operated for delivering a refrigerant;

(b) electromagnetic valve means coupled in parallel to said first cooling means, which is operated to selectively form a first flow mode and a second flow mode, said first flow mode permitting said refrigerant to flow to both said first and second cooling means and said second flow mode permitting said refrigerant to flow only to said second cooling means;

(c) signal generating means for generating a first electrical signal for designating said second flow mode to start rapid freezing, said signal generating means including a rapid freezing switch having a switch knob protruding at least partially from the outer surface of said refrigerator to allow for manual operation by an operator;

(d) detecting means connected to said compressor for detecting an operating condition of said compressor, for generating a first detection signal of high level during refrigerant delivering operation of said compressor and for generating a second detection signal of low level while said compressor is stopped;

(e) flip-flop circuit means connected to said signal generating means, for generating a rapid freezing initiating signal in response to said first electrical signal;

(f) switching means connected to said flip-flop circuit means, said compressor and said valve means, for performing a switching operation to control power supply to said compressor and valve means in response to said rapid freezing initiating signal;

(g) start failure preventing circuit means connected to said detecting means for alternately receiving said first and second detection signals, for detecting a signal level change from high to low, which is caused when said compressor stops, for generating a second electrical signal of low level until a predetermined time passes from the time when said signal level change occurs and for generating a third electrical signal of high level after said predetermined time passes, said start failure preventing circuit means comprising delay circuit means and a diode, said delay circuit means being connected between said detecting means and gate means and including an inverter which receives said first and second detection signals alternately supplied from said detecting means to convert the potential levels of said first and second detection signals and a delay circuit which starts charging when receiving a high level voltage signal from said inverter, generates said second electrical signal during a charging period and discharges at a time constant corresponding to said predetermined time to generate said third electrical signal, and said diode being connected in parallel to said delay circuit for passing therethrough said first detection signal and generating said first detection signal as said second electrical signal when receiving said first detection signal from said detecting means;

(h) gate means, connected to said flip-flop circuit means and said start failure preventing means and having a first input for receiving said rapid freezing initiating signal and a second input for receiving said second and third electrical signals, for allowing said rapid freezing initiating signal to pass therethrough while receiving said third electrical signal from said start failure preventing circuit means and for preventing said rapid freezing initiating signal from passing therethrough while receiving said second electrical signal; and (i) switching means connected to said gate means, compressor and valve means, for receiving said rapid freezing initiating signal through said gate means and for controlling power supply to said compressor and valve means in response to said rapid freezing initiating signal, whereby even when said flip-flop circuit means generates said rapid freezing initiating signal before said predetermined time passes from the time when said compressor stops said refrigerant delivering operation, said rapid freezing initiating signal cannot be transmitted to said switching means so that said compressor is prevented from restarting.

2. A freezing apparatus according to claim 1, wherein said apparatus further comprises cold chamber temperature controlling means provided in said cold chamber and connected to said valve means, for detecting a temperature inside said cold chamber and for permitting said valve means to form said first flow mode when said temperature inside said cold chamber falls below one predetermined reference temperature, and freezing chamber temperature controlling means provided in said freezing chamber and connected to said compressor, for detecting a temperature inside said freezing chamber and stopping said compressor when said temperature inside said freezing chamber falls below another predetermined reference temperature lower than said one predetermined reference temperature; and wherein said switching means comprises a switching transistor which responds to said rapid freezing initiating signal, a switch member serially connected in a power supply line to said valve means and independent of said cold chamber temperature controlling means to perform a switching operation, another switch member serially connected in a power supply line to said compressor and independent of said freezing chamber temperature controlling means to perform a switching operation, and exciting coil means connected to said switching transistor for controlling said switching operation of said switch members in cooperation with said switching transistor and independent of said cold chamber temperature controlling means and said freezing chamber temperature controlling means.

3. An apparatus as in claim 1, further including timer means coupled with said signal generating means for producing, in response to said first electrical signal, a second electrical signal for stopping said high speed freezing operation after the passage of a second predetermined period of time from receipt of said first electrical signal.

4. An apparatus as in claim 3, incuding a time switch having a knob protruding at least partially from the outer surface of said refrigerator and connected to said timer means for manually setting said second predetermined period.

5. A freezing apparatus according to claim 1, wherein said valve means includes drive means coupled with said gate means to selectively receiving said first and second electrical signals, which drives said compressor and opens said valve means during a period of supply of said first electrical signal, while closes said valve means during a period of the supply of said second electrical signal.

6. A freezing apparatus according to claim 5, wherein said valve means is normally closed and so arranged as to open at the time of power supply.

7. A freezing apparatus according to claim 5, wherein said drive means to which said first electrical signal generated from said signal generating means is transmitted includes a relay portion with at least two switch means, said switch means are connected in series with each other, said valve means is connected through said two switch means to a power source, and said compressor is connected through one of said switch means to a power source.

8. A freezing apparatus according to claim 7, wherein said switch means are closed during the period that said first electrical signal generated from said signal generating means is supplied to said relay portion, whereby said valve means and said compressor are supplied with power to be driven.

9. A freezing apparatus according to claim 1, switch includes at least one push lock switch provided between a power line and a ground line.

10. A freezing apparatus according to claim 3, wherein said timer means includes an oscillating circuit and a counter.

11. A freezing apparatus according to claim 1, wherein said detecting means includes a transformer with primary and secondary windings, the primary winding of said transformer is connected to both ends of said compressor, and a given voltage is developed in said secondary winding during the course of operation of said compressor.

12. A freezing apparatus according to claim 1, wherein said gate means includes two NAND networks and a diode, an output terminal of one of said NAND networks is connected to an input terminal of the other NAND network, and an output of the other NAND network is connected through a diode to one of the input terminals of said one NAND network.

13. A freezing apparatus according to claim 3, wherein at least said timer means and said gate means are integrated on one chip substrate.

* * * * *